United States Patent [19]

Toffolon et al.

[11] 4,400,149

[45] Aug. 23, 1983

[54] CONCRETE PIPE MAKING MACHINE WITH REDENSIFICATION APPARATUS

[75] Inventors: Roger L. Toffolon, Hartford; Warren E. Kart, Bristol, both of Conn.

[73] Assignees: Roger L. Toffolon; Atlantic Pipe Corporation, both of Plainville, Conn.

[21] Appl. No.: 346,262

[22] Filed: Feb. 5, 1982

Related U.S. Application Data

[63] Continuation of Ser. No. 204,310, Nov. 5, 1980, abandoned, which is a continuation of Ser. No. 36,297, May 7, 1979, abandoned, which is a continuation of Ser. No. 863,150, Dec. 22, 1977, abandoned.

[51] Int. Cl.[3] ..... B28B 21/14

[52] U.S. Cl. ..... 425/262; 425/427; 425/432; 425/447

[58] Field of Search ..... 425/262, 424, 427, 432, 425/447

[56] References Cited

U.S. PATENT DOCUMENTS

| | | | |
|---|---|---|---|
| 3,655,842 | 4/1972 | Trautner | 425/117 |
| 3,922,133 | 11/1975 | Crawford | 425/262 |
| 3,945,787 | 3/1976 | Walchek | 425/262 |
| 4,041,118 | 8/1977 | Ottman | 425/427 |
| 4,042,315 | 8/1977 | Ottman | 425/424 |

*Primary Examiner*—John A. Parrish

*Attorney, Agent, or Firm*—McCormick, Paulding & Huber

[57] ABSTRACT

A machine for "dry mix" packerhead concrete pipe manufacture has two stations and a separable tubular jacket movable therebetween. A rotatable cylindrical packerhead is movable axially within the jacket and a "dry mix" delivery means deposits mix atop the packerhead as it rotates and moves vertically upwardly within the jacket. The packerhead distributes the mix thereabout to form a concrete pipe in the jacket. A radially expandable and contractable core is movable axially in a contracted condition to a position within the pipe and is then expanded. Vibrators within the core are operated to "redensify" the pipe; that is, to compact the mass thereof, to eliminate voids, and to relieve residual forming stresses therein. A guide ring is employed to align the contracted core axially with the pipe during entry and further guiding and supporting devices for the core are provided. Core entry and withdrawal is power actuated as is core expansion and contraction within the pipe. Expansion and contraction devices may comprise fluid cylinders operated adjacent a single axial split line in the core or, true circle expansion and contraction means may be provided with a core having one or more axial split lines.

26 Claims, 13 Drawing Figures

CONCRETE PIPE MAKING MACHINE WITH REDENSIFICATION APPARATUS

REFERENCE TO CONTINUING DATA

This is a continuation of Ser. No. 204,310 filed Nov. 5, 1980, now abandoned, which is a continuation of Ser. No. 36,297 filed May 7, 1979, abandoned, of Ser. No. 863,150 filed Dec. 22, 1977, also abandoned.

BACKGROUND OF THE INVENTION

The "dry mix" packerhead method of concrete pipe manufacture has gained wide acceptance in recent years. The predecessor "wet mix" method required a relatively long term curing period with forms in place and was not conductive to high rates of production. With the "dry mix" packerhead method, a separable external form or jacket is employed and may be removed almost immediately on formation of a pipe therewithin. The "green" formed pipe has sufficient structural integrity to stand upright on its own and may be transported to a curing oven for a substantially shorter curing operation, the jacket being returned to the pipe making machine for the formation of a succeeding pipe.

Generally, the dry mix packerhead method comprises the steps of positioning a separable tubular jacket beneath a rotatable and axially movable packerhead having an associated dry mix delivery means. The packerhead is lowered within the jacket, having an external diameter somewhat smaller than the internal diameter of the jacket, and is drawn slowly upwardly through the jacket. The packerhead is rotated during its upward movement and mix is delivered to its upper surface and discharged radially outwardly to form the pipe in the annular space between the periphery of the packerhead and the jacket. The peripheral surface of the packerhead trowels the internal surface of the pipe and compacts the pipe during its upward rotary movement.

While the packerhead method of pipe manufacture has proven generally satisfactory, it has been found that toroidal and other residual stresses occur in the pipe and this may be particularly troublesome when steel reinforcement members are employed. Such members may also be stressed during pipe formation and significant circumferential displacement of axially extending members may occur. Residual stresses in the wall of the pipe and in the steel reinforcement therein may result in defective and even in a worthless end product.

In overcoming the stress problems encountered, a step known as "redensification" has been employed in the more recent manufacture of concrete pipe. Redensification involves the application of vibratory motion to the pipe for further compaction, elimination of voids, and especially for the relief of residual stresses in the pipe and/or steel reinforcement therein.

U.S. Patent to Trautner U.S. Pat. No. 3,655,842 entitled METHOD OF VIBRATING CORE IN CONCRETE PIPE MAKING MACHINE, illustrates and describes one method and apparatus for concrete pipe redensification. In this patent, a vibrating "redensifying" core is positioned beneath a forming jacket and an associated packerhead and is drawn upwardly through the pipe during packerhead formation of the pipe. Obviously, radial dimensions of the core are critical. If the core is small enough so as to be drawn upwardly through the pipe without marring the pipe internal surface an inferior redensification operation may result. That is, firm engagement of the vibrating core with the wall of the pipe will not be achieved and pipe compaction and stress relief will not occur uniformly throughout the mass of the pipe and the steel reinforcement. If, on the other hand, a larger core is employed, the internal surface of the pipe may be scarred and severely damaged during core entry and withdrawal. Even with a larger core firm engagement between the core and pipe may not be achieved uniformly throughout the area of the pipe inner surface and inconsistent compaction and stress relief may result.

U.S. Pat. Nos. 4,041,118 and 4,042,315, owned by the Assignee of the present application and respectively entitled METHOD AND APPARATUS FOR MAKING CONCRETE PIPE and APPARATUS FOR MAKING CONCRETE PIPE illustrate and describe an improved method and apparatus for concrete pipe redensification. An expandable and contractable vibrating or redensifying core is employed and problems of core entry and withdrawal are overcome. Further, it has been found that pressure engagement of the expanded core with the internal surface of the pipe during vibration results in a much improved redensification operation. Pipe compaction and stress relief is greatly enhanced and a superior end product results. Problems are encountered, however, with the method and apparatus of these patents. The packerhead formed pipe must be lifted from the pipe making machine in its jacket, transported horizontally and then lowered into position about the core. After redensification, the pipe and jacket must be lifted from the core and returned to the pipe making machine for a subsequent finishing operation by the packerhead, this consisting in a final pass of the packerhead with mix added to trowel and finish the pipe interior surface and to fill any void that may occur at the top of the pipe due to slumping during redensification. Obviously, the jacket and the green pipe therewithin must be handled with extreme care and are very heavy and unwieldy elements for transport at high rates of movement. The operation thus entails severe inherent impediments to pipe manufacture at high rates of production.

It is the general object of the present invention to provide a high production concrete pipe making machine of the dry mix packerhead type and which includes improved redensification apparatus adapted for power driven and automatic operation.

A further object of the invention resides in the provision of a machine of the type mentioned wherein heavy forming jackets and pipes therewithin may be moved rapidly and efficiently from one machine station to another without lifting and transporting or otherwise removing the same from the pipe making machine.

A still further object of the invention resides in the provision of the pipe making machine of the type mentioned wherein a radially expandable and contractable vibrating core is provided and adapted for fast and efficient entry and withdrawal from a packerhead formed pipe.

A still further object of the invention resides in the provision of a pipe making machine of the type mentioned wherein automatically operable guide and support means are provided for the vibrating core to insure precise axial alignment of the core with the pipe during entry and withdrawal.

A still further object of the invention resides in the provision of a machine of the type mentioned wherein an improved true circle core expansion and contraction mechanism is provided.

SUMMARY OF THE INVENTION

In fulfillment of the foregoing objects, a pipe making machine of the packerhead type is preferably provided with at least two stations and with at least one separable tubular jacket for the formation of pipe therewithin. The jacket is supported in a vertically open attitude and is movable between said stations on a massive support means and lifting or other dislodgement of the pipe and jacket from the support means is unnecessary. A rotatable cylindrical packerhead at one of the stations has an external diameter substantially less than the internal diameter of the jacket and is axially aligned with the jacket. A dry mix delivery means associated with the packerhead progressively deposits mix atop the packerhead, the packerhead rotating and moving vertically upwardly within the jacket so that the mix is distributed radially outwardly to form a concrete pipe in the annular space between the jacket and the periphery of the packerhead.

A radially expandable and contractable core is also provided and has a vertical dimension at least as long as the jacket and an external diameter approximating the internal diameter of a pipe formed by the packerhead. The core is preferably located at a second machine station and has associated power operated means for expanding and contracting and for moving the same vertically between first and second positions relative to the pipe and jacket. The first position is vertically displaced from the pipe and the second and operative position is within and concentric with the pipe and jacket. During movement of the core between its first and second positions the power operated means maintains the core in a contracted condition and when the core is in its second position within the pipe, the said means expands the core into pressure engagement with the internal pipe surface. With the core and pipe surface under firm pressure engagement vibrators within the core are operated to compact, to eliminate voids, and to relieve residual forming stresses in the pipe and/or in steel reinforcement members therein.

Precise axial alignment means operate during entry and withdrawal of the core to provide for rapid and efficient core movement. Further support and guide means for the core are of desirably simple construction and assist the axial alignment means in precise vertical core movement. Radially expandable and contractable connecting and support means for the core cooperate with the aforementioned guide and support means and with the power operated means in moving the core vertically and, in one embodiment of the invention, the connecting and support means also serve as actuating means for expanding and contracting the core. In said embodiment, true circle expansion operation is provided for and a single fluid operable cylinder may be employed for both vertical core movement and for core expansion and contraction. Alternatively, the power operated means may comprise first and second fluid operable cylinders respectively for moving the core vertically and for expanding and contracting the same.

DESCRIPTION OF PREFERRED EMBODIMENTS

Referring particularly to FIGS. 1-5, a pipe making machine in accordance with the invention is indicated generally at 10 and a single pipe forming jacket is illustrated at 12. A number of jackets 12, 12 are usually provided and positioned successively as shown beneath a packerhead 14 for the formation of pipes therewithin. The jacket 12 and packerhead 14 are shown at a Station A in the pipe making machine in vertical alignment and the jacket 12 rests on a massive support means in the form of a turntable 16. The turntable 16 is of sturdy construction for support of the substantial weight of the jacket and pipe and is rotatable by suitable drive means, not shown, to move the jacket 12 from the FIGS. 1-2 position at Station A to the FIGS. 3-5 position at Station B in the machine. There may also be one or more additional stations for loading, unloading, etc. In movement between stations, the jacket and pipe therewithin remain in a fixed position on and relative to the turntable and precise vertical alignment or registry of the pipe with operating mechanism at the stations is assured. When station to station movement is terminated at completion of a pipe, the jacket and pipe may be removed from the turntable at an unloading station for transport to a curing oven.

Figure 9:
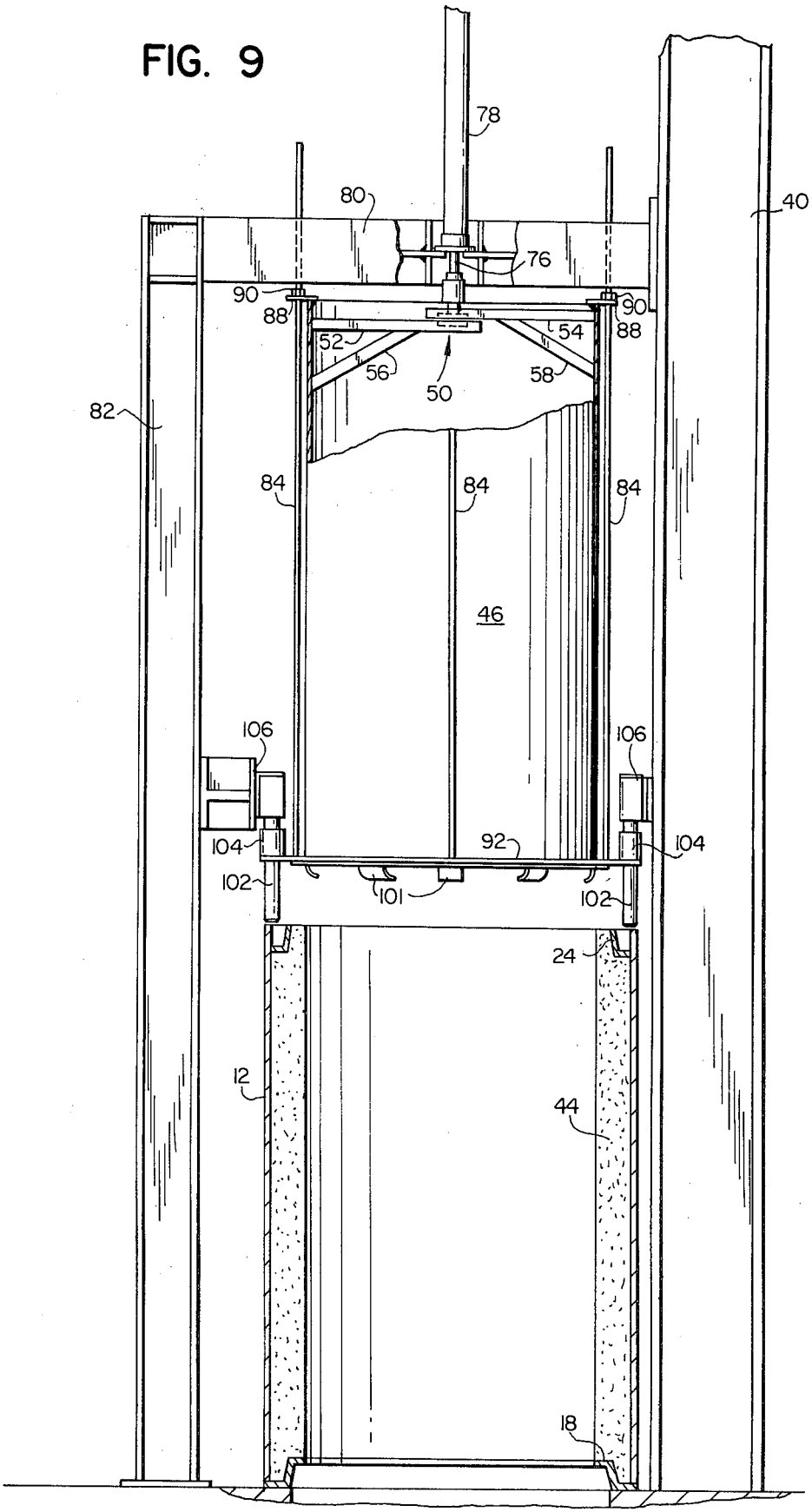
FIG. 9 is an enlarged schematic elevation showing a redensification station with a vibrating core disposed externally and above a pipe.
Figure 10:
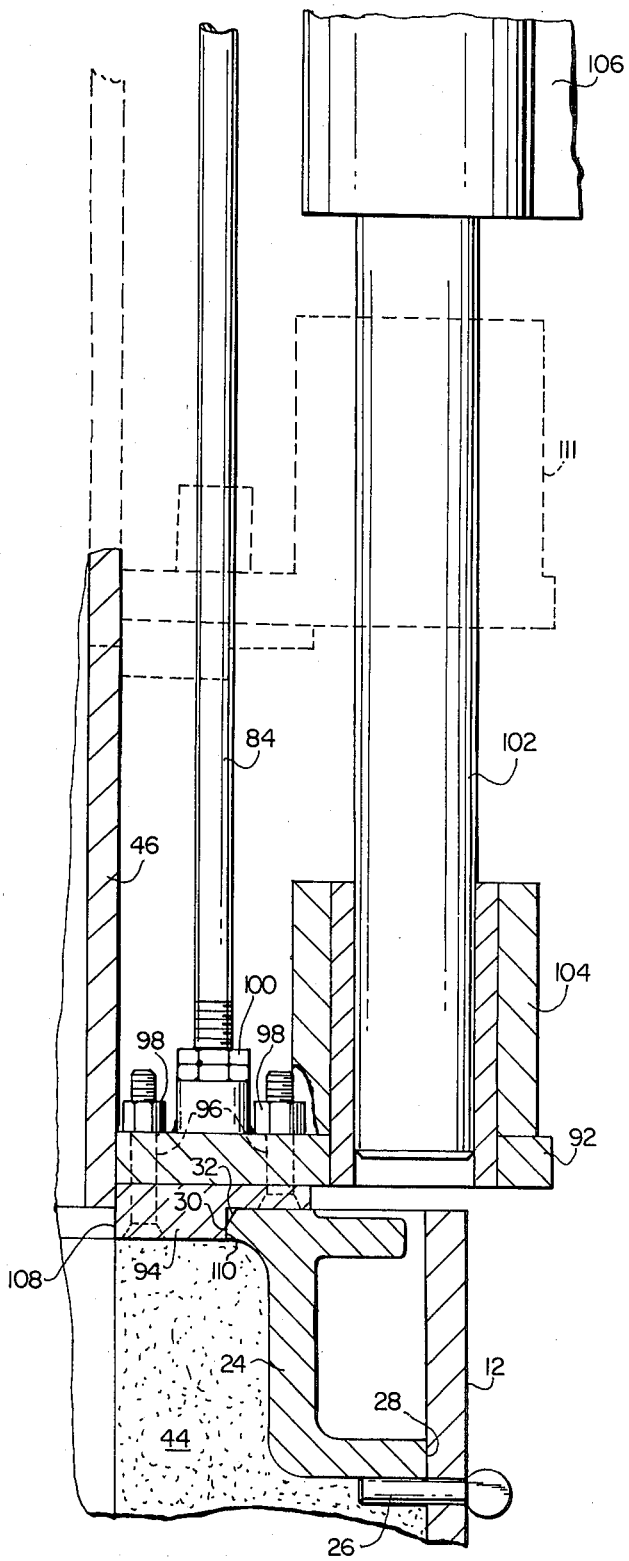
FIG. 10 is a further enlarged fragmentary vertical section showing a part of an upper portion of a pipe, its jacket, a portion of a redensification core and associated axial alignment and guide means.

The jacket 12 may be conventional and a heavy steel construction is usually employed with the jacket taking a tubular form and adapted for hinged or other separation along at least one axially extending line for removal from a pipe. The jacket is maintained in an upright and vertically open attitude for pipe formation and a bottom or bell ring is ordinarily positioned at a lower end portion thereof as indicated at 18. The bell ring is conventionally of heavy steel construction and usually remains with the pipe through the curing operation. Central circular opening 20 in the bell ring is of course concentric with the jacket 12 and aligned axially with a circular opening 22 therebeneath in the turntable 16. The openings 20, 22 accommodate vertical passage of the packerhead 14. At an upper end portion of the jacket 12, a heavy steel top or spigot ring 24 is provided as best illustrated in FIGS. 9 and 10. The spigot ring 24 assists in forming the desired configuration at the upper end portion of the pipe and may be removed after curing. The spigot ring is concentric with the jacket 12 and is fixed relative thereto when secured in position as illustrated in FIG. 10.

A series of removable spigot ring locating and support pins 26, 26, one shown in FIG. 10, are provided about the jacket 12 and the ring peripheral surface 18 locates against the interior of the jacket. The ring internal diameter is ordinarily somehwat smaller than the associated pipe and an annular axial locating surface is provided at 30. Adjacent and above the surface 30 an annular chamfer 32 serves a purpose to be set forth below.

Returning to FIGS. 1–2 the packerhead 14 is or may be of conventional construction and takes the form of a cylindrical member having an upwardly exposed surface 34 for receiving dry mix from an associated delivery means. The packerhead has an actuating rod or shaft 36 supported by an overhanging frame 38 in turn mounted on an upright frame member 40. The shaft 36 is power driven by conventional means, not shown, for both rotation and vertical movement in axial alignment with the pipe forming jacket 12.

A dry mix delivery means illustrated schematically may comprise a funnel 41 discharging to a conveyor 42 which in turn discharges at a left hand end portion atop the packerhead 14.

When a pipe is to be formed at the Station A, the packerhead 14 is lowered within the jacket 12 and the bell ring opening 20 and is then drawn slowly upwardly and simultaneously rotated with mix progressively delivered to its top surface 34 from the conveyor 42. Mix directing means may be provided on the packerhead surface 34 and as the packerhead progresses upwardly the mix is delivered radially outwardly and a pipe is formed in the annular space between the periphery of the packerhead and the jacket 12, FIG. 2. The peripheral surface of the packerhead trowels and compacts the pipe as it moves upwardly and on completion of an upward pass of the head, a pipe 44 is completely formed within the jacket as illustrated in FIGS. 3 et sequa.

Figure 1:
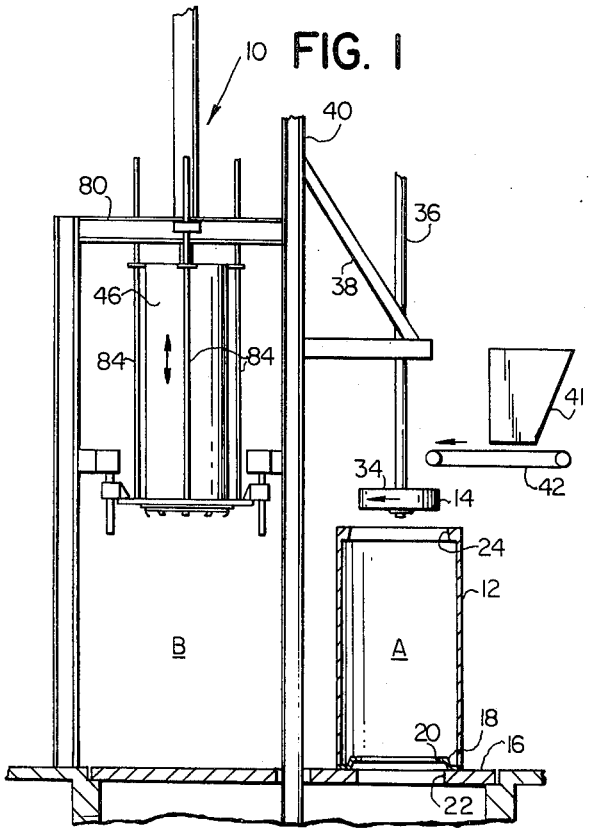
FIG. 1 is a schematic elevational view showing an improved packerhead pipe making machine in accordance with the present invention, a pipe forming jacket and packerhead being illustrated in positions of readiness for forming a pipe.
Figure 2:
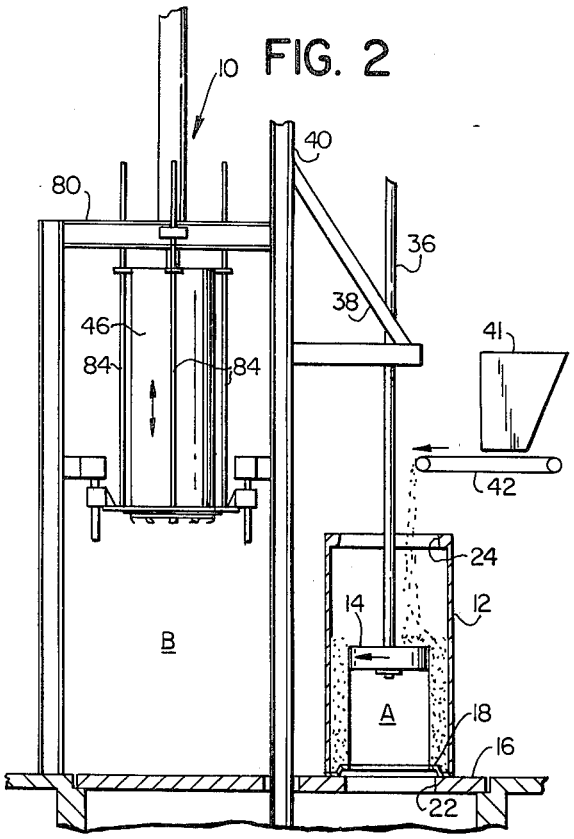
FIG. 2 is a schematic elevation similar to FIG. 1 but showing the pipe partially formed by the packerhead within its jacket.
Figure 3:
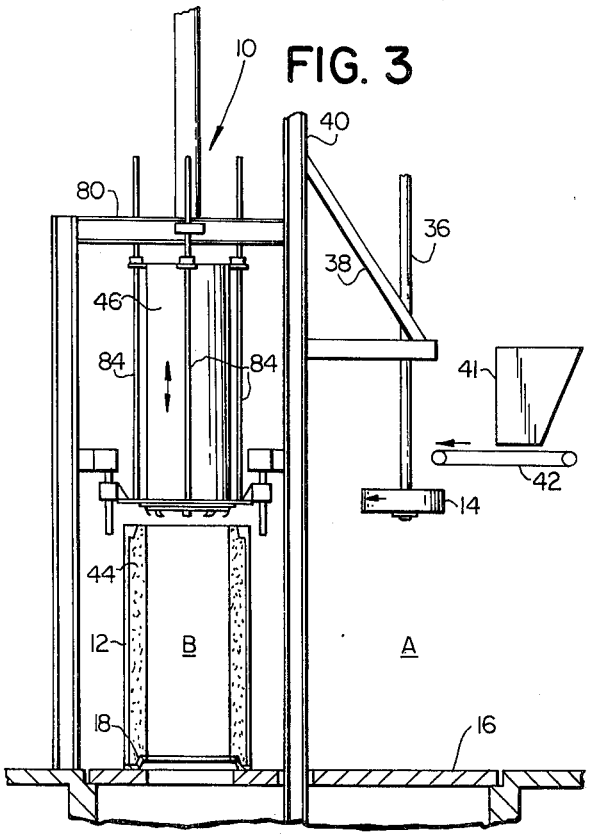
FIG. 3 is a schematic elevation similar to FIGS. 1-2 but shows the jacket and fully formed pipe at a second or redensification station in the machine, a redensification core being illustrated externally of the pipe.
Figure 4:
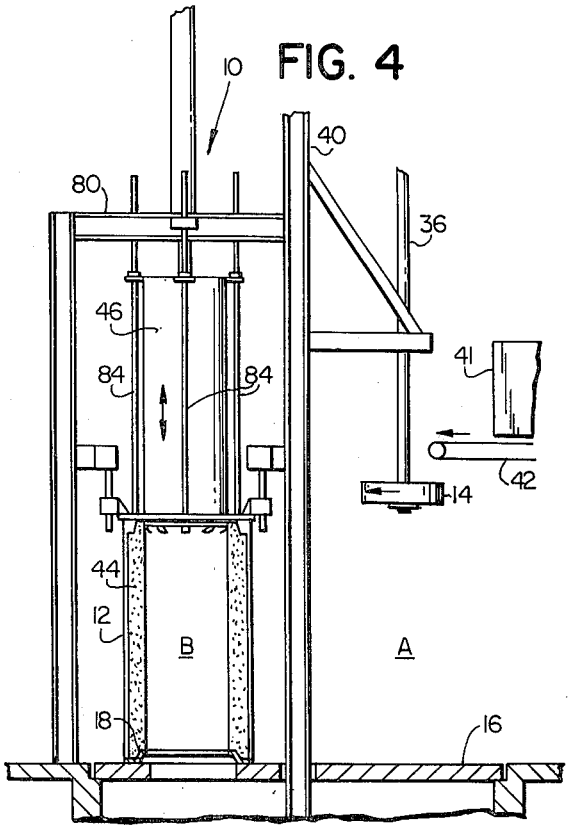
FIG. 4 is a schematic elevation similar to FIG. 3 but showing the redensification core in an initially lowered position.

In FIG. 3 the pipe 44 and its jacket 12 are shown at a redensification Station B, the turntable 16 having been rotated through 180° from the position of FIGS. 1 and 2. Redensification cylinder or core 46 is supported above the pipe 44 and jacket 12 and is movable vertically for entry and withdrawal from the pipe. That is, the core 46 has a first position as shown in FIG. 3 external of and spaced above the pipe 44 and a second and operative position within the pipe, FIG. 5. The core 46 is radially expandable and contractable and is moved downwardly within the pipe in a contracted condition and thereafter expanded into pressure engagement with the internal surface of the pipe for vibration and redensification.

Figure 6:
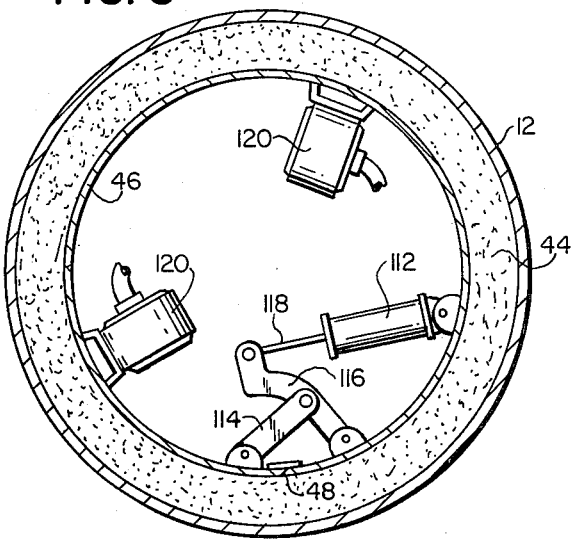
FIG. 6 is a somewhat schematic and enlarged top view of a pipe jacket, a pipe therewithin, and a redensification core within the pipe.

In a presently preferred form, the core 46 is of tubular sheet metal construction and is split along at least one axial line for expansion and contraction. As best illustrated in FIG. 6 the core 46 has an inclined axial split line at 48. Relative sliding action may occur between adjacent end surfaces at the split line 48 during core expansion and contraction. The length of the core is at least equal to the length of pipe 44 and its external diameter is approximately equal to the internal diameter of the pipe. That is, the core is so dimensioned diametrically as to freely slide axially within the pipe in its contracted condition and to firmly engage and exert pressure on the internal surface of the pipe in an expanded condition.

Figure 7:
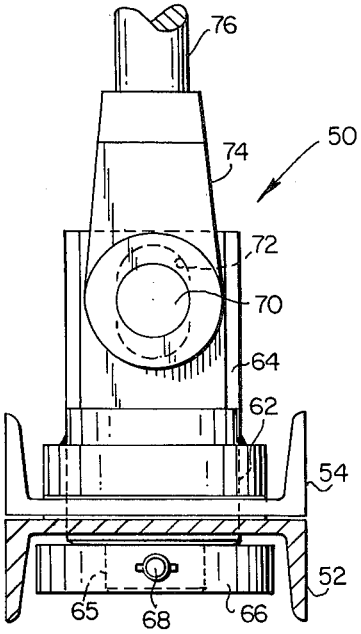
FIG. 7 is an enlarged vertical section through one form of connecting and supporting means for an expandable and contractable core.
Figure 8:
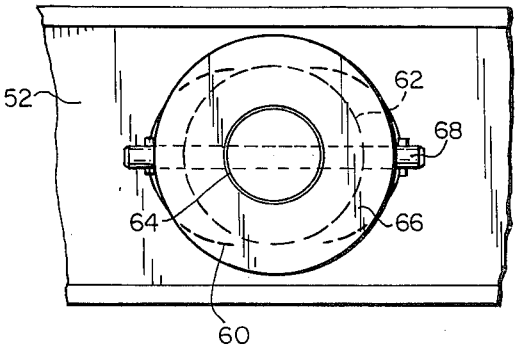
FIG. 8 is a bottom view of the connecting and support means of FIG. 7.

A radially expandable supporting and connecting means 50 for the core 46 is best illustrated in FIGS. 7, 8 and 9. The supporting and connecting means includes a pair of radially movable members in the form of channels 52, 54 which are reversely oriented, FIG. 7, for relative sliding movement and which have outer end portions connected to the core 46 as by welding. Inclined brace members 56, 58 may also be provided as illustrated in FIG. 9. At adjacent inner end portions, the channels 52, 54 are each provided with an elongated slot as shown, the slots being coincident and shown in broken line form at 60 in FIG. 8. The slots 60, 60 receive a downwardly projecting cylindrical portion 62 of a yoke 64 and the channels 52, 54 are thus radially slidable relative to the projection 62 for core expansion and contraction. A diametrically reduced projection 65 beneath the projection 62 has an associated cylindrical support plate 66 which is connected thereto by a pin 68 whereby to suspend the channels 52, 54 and the core 46 from the yoke 64. The pin 68 and plate 66 provide a ready disconnect for the selective mounting of cores of various sizes on the yoke 64, each such core having channels similar to the channels 52, 54. Concrete pipe of various sizes is thus accommodated for redensification.

The yoke 64 carries a cross shaft 70 entered in a vertically elongated slot 72 in a fitting 74 at a lower end portion of an actuating rod 76 forming a part of a fluid operable cylinder 78, FIG. 9. The cylinder 78 forms a part of a power operated means for the core 46 and is mounted on a cross frame member 80 supported between the machine frame member 40 and a second vertical frame member 82. The cylinder 78 is vertically oriented so that its actuating rod 76 is movable axially with respect to the core 46 and pipe 44 whereby to move the core between its aforementioned first and second positions respectively above and within the pipe 44.

Core guides comprising vertically extending rods 84, 84 are adapted to move vertically and the core 46 moves vertically both with and relative to the rods. Four (4) rods are shown with side rods 84, 84 slidably mounted in the cross member 80 and with front and rear rods 84, 84 slidable in suitable brackets 86, one shown, FIGS. 1–5. The four guide rods 84, 84 have four apertured ears 88, 88 respectively slidable therealong and which have inner end portions connected with an upper end portion of the core 46 as by welding. The ears 88, 88 may also serve as stop means in cooperation with stop means on the rods 84, 84 in the form of nuts 90, 90, adjustably positioned on threaded portions of the rods. Various size cores for pipes of varying diameter may of course have ears 88, 88 of varying radial dimension so as to permit engagement with the horizontally fixed rods 84, 84.

At their lower end portions, the guide rods 84, 84 are connected with a support ring 92, FIGS. 9 and 10, which forms a part of a support means for a guide ring 94, FIG. 10. The support ring 92 carries the guide ring 94 which may e detachably secured in position beneath the support ring as by means of bolts and nuts 96, 98. The support ring 92 is in turn adjustably secured to lower end portions of the rods 84 by means of nuts 100, 100, one shown in FIG. 10. A pair of vertically extending guide members or rods 102, 102 for the support ring 92 respectively enter and slidably engage a pair of sleeves 104, 104 fixed to the support ring. The rods 102, 102 depend from mounting brackets 106, 106 secured respectively to the machine frame members 40 and 82, FIG. 9.

From the foregoing it will be apparent that the guide ring 94 can serve as an axial aligning means for the core 46 during entry and withdrawal of the core from the pipe 44. The guide ring 94 has a cylindrical opening 108 and the axially extending wall thereof serves as a guide or aligning surface for the external peripheral surface of the core 46. Guide rings 94, 94 may of course be provided in various sizes for various cores but each such ring is provided with an axially extending annular locating surface 110. The axially extending locating surface 110 cooperates with the aforementioned axially extending locating surface 30 on the spigot ring 24 when the guide ring 94 is positioned as shown in FIG. 10. The slight chamfer 32 on the spigot ring 24 adjacent the locating surface 30 facilitates precise engagement of the surfaces 110, 30. Spigot ring 24 is concentric with the jacket 12 as mentioned and is fixed in relationship thereto. Thus, the guide ring 94 is held in operative association with the upper end of a pipe 44 and jacket 12 for precise axial alignment of a core 46 when the ring is positioned as shown in FIG. 10.

The guide ring 94 is also movable to a first or upper position from the lower or operative position shown in FIG. 10. In the FIG. 10 position of the ring the core 46 is shown in an intermediate position with a lower end portion thereof in engagement with the wall of the cylindrical opening 108 in the guide ring. The guide ring 94 remains in the position shown during further downward movement of the core 46 until the latter is fully entered into the interior space of the pipe 44. On completion of core vibration and when the core 46 is withdrawn upwardly by the cylinder 78, the ears 88, 88 on the core engage the nuts 90, 90 on the guide rods 84, 84 whereby terminally to lift the guide rods through a limited vertical distance. Lifting of the guide rods 84, 84 results in upward withdrawal of the support ring 92 and guide ring 94 from its second or operative position to a position such as the broken line position 111 in FIG. 10. On a subsequent downward movement of the core 46 for redensification of a succeeding pipe 44, the guide rods 84, 84, support ring 92, and guide ring 94 initially move downwardly to the operative position of FIG. 10. Continued downward movement of the core 46 occurs with the ears 88, 88 sliding downwardly along the stationary rods 84, 84 until the core is fully entered within the pipe. As illustrated, the support ring 92 and guide ring 94 should precede the core 46 in downward movement so that the ring 94 will be seated on the spigot ring 24 as shown prior to entry of the core lower end portion within the pipe. Proper adjustment of the nuts 90, 90 and 100, 100 will insure this condition.

Preferably the core is also provided with downwardly and inwardly inclined guide fingers 101, 101 at a lower end portion.

Figure 5:
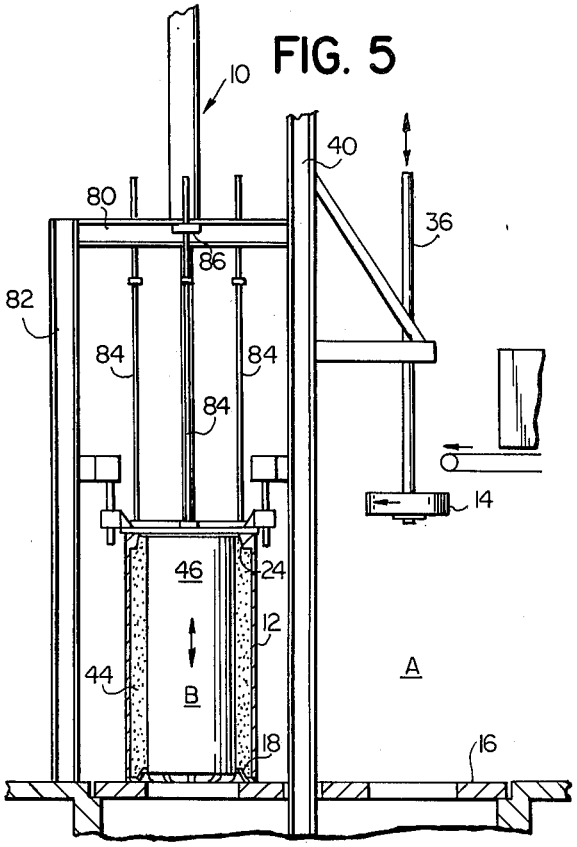
FIG. 5 is a schematic elevation similar to FIG. 4 but showing the redensification core in an operative position within the pipe.

Operation of the pipe making machine at the redensification Station B will be apparent from the foregoing. With a pipe and jacket positioned as shown in FIG. 3 the core 46 may be moved downwardly to its operative position within the pipe as illustrated in FIG. 5. When the core is so positioned, core expansion can be effected by a second fluid operable cylinder 112 and an associated linkage 114, 116, FIG. 6. The linkage 114, 116, connected to the core 46 on opposite sides of the split line 48, operates on movement of cylinder actuating rod 118 in one and an opposite direction respectively to expand and contract the core. The cylinder 112 forms a further part of the power operated means for the core 46. Vibrators 120, 120 shown schematically in FIG. 6 within the core 46 serve during redensification to vibrate the core and to compact the pipe and relieve stresses. On completion of redensification, the core 46 is contracted by the cylinder 112 and the cylinder 78 withdraws the core 46 upwardly to the FIG. 3 position with the support ring 92 and guide ring 94 being lifted to the broken line position of FIG. 10. The pipe 44 and jacket 12 may thereafter be returned to Station A as in FIGS. 1 and 2 and a final pass of the packerhead 14 will result in a completed pipe. Unloading and curing of the green pipe may then be accomplished.

Figure 11:
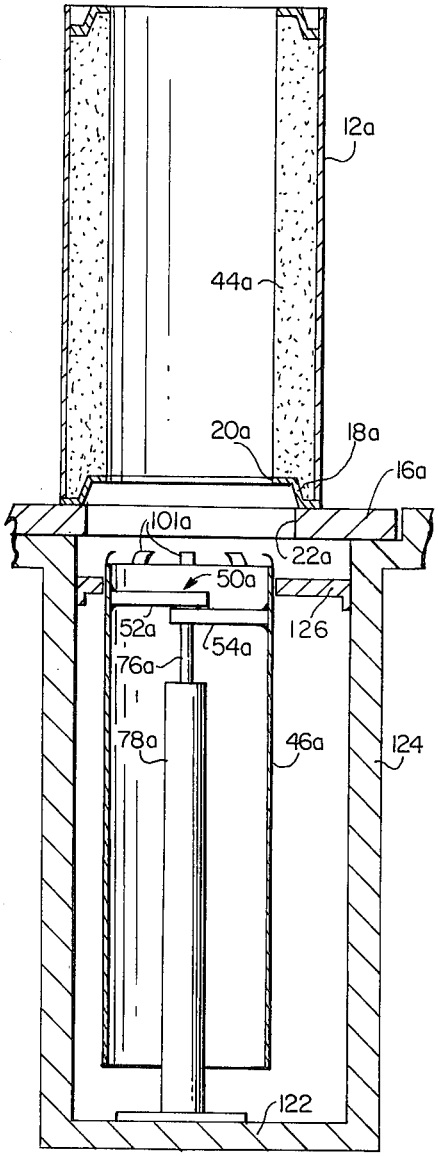
FIG. 11 is a schematic elevation of a pipe and jacket and an alternative form of redensification core disposed externally of and beneath the pipe.

In a second embodiment of the invention illustrated in FIG. 11 a core **46*a* is disposed beneath rather than above a pipe 44*a* in its first or inoperative position. The core is movable upwardly within the pipe 44*a* to its second or operative position and may be located at a pipe forming station or a separate redensification station. Power operated means for moving the core upwardly and downwardly includes a fluid cylinder 78*a* having a rod 76*a* and which is mounted on a base member 122 in a pit defined by a generally cylindrical wall 124. The actuating rod 76*a* is attached to a core supporting and connecting means 50*a* which may be identical with that described above and which includes relatively radially movable members 52*a*, 54*a***.

In upward movement toward its operative position the core **46*a* passes through opening 22*a* in turntable 16*a* and bell ring 18*a* associated with the pipe 44*a*. A preliminary or rough guide means may take the form of an annular guide ring 126 disposed about the core 46*a* and secured to the wall 124. The peripheral surface opening 20*a* in the bell ring 18*a* is engaged by an upper or leading end of the core 46*a* as it is moved into the pipe 44*a* and provides a secondary or fine guide means. Thus, the bell ring 18*a* serves as an axial aligning means in this embodiment of the invention and corresponds to the guide ring 94 of the FIG. 1–10 embodiment. As in the case of the core 46, the core 46*a* is preferably provided with guide fingers 101*a*, 101*a* which are upwardly and inwardly inclined at its upper end portion for ease of entry to the pipe 44*a***.

The core **46*a* may be identical with the core 46 and may include the vibrators and fluid cylinder expansion and contraction mechanism therewithin as described above and illustrated in FIG. 6**.

Figure 12:
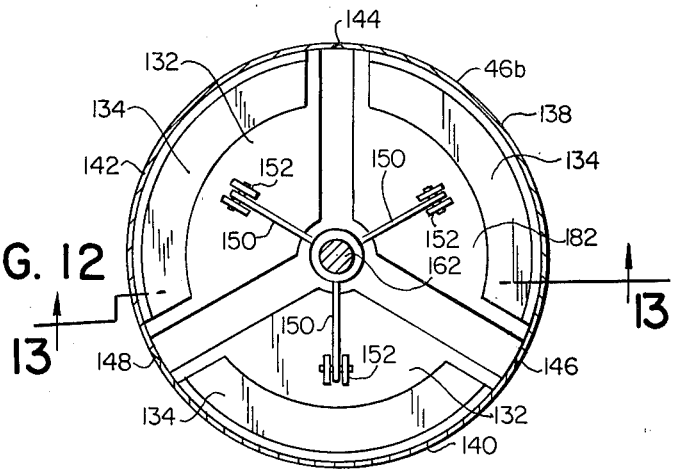
FIG. 12 is a top view of an alternative form of a redensification core embodying a true circle expansion mechanism.
Figure 13:
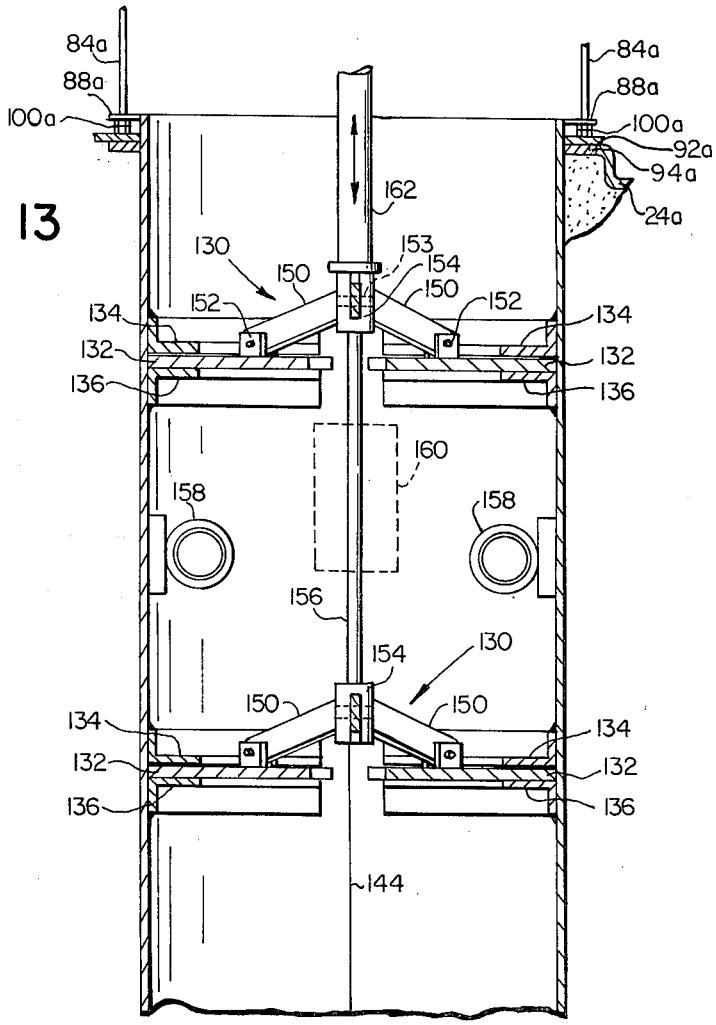
FIG. 13 is a vertical section taken generally as indicated at 13—13 in FIG. 12.

Referring particularly to FIGS. 12 and 13, a further embodiment of the invention includes a core **46*b* and a true circle expansion and contraction means indicated generally at 130, 130. As will be apparent the above described cores 46 and 46*a* may take a slightly oval configuration in their expanded condition, expansion force being exerted only at the localized area adjacent the split line 48 by the links 114, 116. While only slight ovalizing may occur, the phenomena may nevertheless have a detrimental effect in the redensification operation. The core 46***b*, on the other hand, is adapted to provide a true or perfect circle cross sectional configuration at least in its expanded condition.

The upper and lower true circle expansion means 130, 130 serve as core connecting and supporting means and also serve the function of expanding and contracting the core 46*b*. At least two radially movable members are provided and in the FIG. 12–13 embodiment three (3) such members 132, 132 are employed. The members 132, 132 take a segmental shape viewed from above in FIG. 12 and extend through an angle slightly less than 270°. The members 132, 132 of the lower expansion means 130 in FIG. 13 are identical with the members 132, 132 shown in FIG. 12 as are all like numbered elements. Each member 132, 132 has associated upper and lower guide members 134, 136 secured to the core 46*b* as by welding and which slidably receive the members 132, 132 for radial inward and outward movement. In FIGS. 12 and 13 the core 46*b* is constructed in three similar sections, 138, 140 and 142 with axial split lines 144, 146 and 148 therebetween and the members 132, 132 may be respectively connected with the core sections at their outer end portions. Thus, radial outward movement of the members 132, 132 will result in core expansion and radial inward movement will positively draw the core sections 138, 140 and 142 radially inwardly for core contraction. Alternatively, the members 132, 132 may merely engage the core at outer end portions with relative sliding movement permitted therebetween and the core may be adapted to inherently spring inwardly to a contracted condition. That is, the core may be constructed in one or more sections and with the characteristic of assuming a contracted condition in its free state. The members 132, 132 need then serve merely to expand the core and the core will contract due to its own inherent reactive forces.

The manner in which the members 132, 132 are urged outwardly or, alternatively, positively driven both radially outwardly and inwardly may vary within the scope of the invention. As shown, the members 132, 132 are positvely driven in both directions of radial movement by a motion transmitting mechanism associated therewith. The motion transmitting mechanism converts axial movement to radial movement and is illustrated as including three (3) actuating links 150, 150. The links 150, 150 are associated respectively with the members 132, 132 and have outer end portions pivotally connected thereto by means of brackets 152, 152. Inner end portions of the links 150, 150 are pivotally connected to a yoke member 154 as at broken line 153 so that axial movement of the yoke in one and an opposite direction will result in radial movement of the members 132, 132 in one and an opposite direction. As illustrated in FIG. 13, movement of the yokes 154, 154 may be effected in a downward direction to expand the core and in an upward direction to contract the core. The yokes 154, 154 are shown interconnected by rod 156 for operation in unison.

Power operated expansion and contraction of core 46*b* may be accomplished by a second fluid operable cylinder as in the embodiments above. That is, a fluid cylinder may be disposed as indicated by broken line 160 with a through actuating rod 156 to simultaneously operate the yokes 154, 154. Preferably however, a single fluid operable cylinder is employed in the FIGS. 12–13 embodiment both for moving the core 46*b* vertically between its first and second or operative and inoperative positions and for expanding and contracting the core. Thus, an actuating rod 162 may be assumed to correspond with the actuating rods 76 and 76*a* of the fluid cylinders 78, 78*a* in the embodiments above. The rod 162 is connected with the upper yoke 154 and indirectly with the lower yoke 154 via the connecting rod 156. Obviously, slight downward movement of actuating rod 162 will result in core expansion and slight upward movement in core contraction.

The core 46*b* is shown in FIGS. 12 and 13 for operation from above a pipe as in FIGS. 1–10 but is equally adaptable for use beneath the pipe as in FIG. 11. With support and guide means of the type shown in FIGS. 1–10, a convenient stop and over travel operation is available. That is, core guide rods 84*a*, 84*a* in FIG. 13 may serve the same function as in FIGS 1–10 but associated nuts 100*a*, 100*a* may also serve a stop function in cooperation with core ears 88*a*, 88*a*. That is, the nuts 100*a*, 100*a* may be properly positioned to serve as fixed stop means cooperating with the ears 88*a*, 88*a* serving as movable stop means. Thus, on downward movement of the core 46*b* at the urging of the actuating rod 162 and its associated fluid cylinder, not shown, the ears 88*a*, 88*a* will engage the nuts 100*a*, 100*a*, and the core 46*b* will be stopped at the desired position of operation within a pipe and jacket. Slight continued downward movement of the actuating rod 162 in an overtravel operation will thereupon result in expansion of the members 132, 132 and in core expansion into firm pressure engagement with the wall of the pipe. With vibrators 158, 158 operating, redensification will be accomplished and when the actuating rod 162 is thereafter drawn upwardly, initial upward movement will result in contraction of the core with further upward movement of the rod 162 withdrawing the core from the pipe.

From the foregoing it will be apparent that the core 46*b* of FIGS. 12–13 provides true circle expansion for enhanced redensification operation and is also so constructed as to permit the elimination of a second or separate fluid cylinder for core expansion and contraction. Sequencing of fluid cylinder control valves and the like may thus be eliminated and high speed automatic core operation readily provided for. In all embodiments of the invention, the problem of handling and precise positioning of massive pipes and jackets is eliminated and a highly efficient redensification operation is provided for. Thus, high production rates have been provided for and enhanced pressure redensification results in a superior end product.

We claim:

1. In a machine for the "dry mix" packerhead manufacture of concrete pipe having at least two stations and at least one separable tubular jacket for the formation of pipe therewithin; the combination comprising means for supporting said jacket in a vertically open attitude at each of said stations and for transferring the jacket with a pipe formed therewithin between said stations, a rotatable cylindrical packerhead at one of said stations having an external diameter substantially less than the internal diameter of said jacket, said packerhead being axially aligned with and movable vertically within and above a jacket supported at said one station, "dry mix" delivery means associated with said packerhead at said one station for progressively depositing the mix atop the packerhead with the packerhead rotating and moving vertically upwardly within the jacket whereby to distribute the mix radially outwardly from the packerhead and to form a concrete pipe in the annular space between the jacket and the periphery of the packerhead, a radially expandable and contractable core at the other station approximately as long as the jacket and having an external diameter approximating the internal diameter of a pipe formed at said one station, power operated means for expanding and contracting said core and for moving the core vertically between first and second positions relative to a jacket and formed pipe at said other stations, the first position being vertically displaced from the jacket and the second position being within and concentric with the pipe and jacket, an annular axial alignment means at said other station adapted to be in operative association with one end of a pipe supported in a jacket at said other station, said axial alignment means having a cylindrical opening of a diameter substantially equal to the internal diameter of the pipe and serving the guide the core during vertical movement from its said first position to its second position within the pipe, said annular axial alignment means being movable between first and second positions relative to the pipe and jacket, and said axial alignment means in its first position being spaced vertically from said pipe and jacket and in its second position being adjacent said pipe and jacket and connected therewith so as to align axially with respect thereto, said power operated means serving also to contract the core during movement relative to the jacket and pipe and to expand the core into firm engagement with the internal diameter of the pipe when the core is in its said second position, and at least one vibrator operatively associated with said core for vibrating the same in its said expanded second position whereby to compact the pipe, to eliminate voids, and to relieve forming stresses therein.

2. The combination in a machine for the manufacture of concrete pipe as set forth in claim 1 wherein an annular spigot end ring is provided at an upper end portion of the jacket and pipe and is releasably secured in fixed relationship to an upper end portion of the jacket with an exposed axially extending locating surface, and wherein said axial alignment means has a complementary locating surface engageable with said end ring locating surface when the alignment means is in its said second position, the engagement of said two surfaces serving to align the alignment means axially with the end ring, the jacket and the pipe therewithin.

3. The combination in a machine for the manufacture of concrete pipe as set forth in claim 1 wherein said alignment means includes a guide ring, wherein a guide ring support means is provided for moving the ring between the first and second positions of the axial alignment means wherein at least one vertically extending guide member is provided in operative association with said support means for movement of the support means upwardly and downwardly therealong, and wherein said support means is connected with said power operated means and movable along the guide member at the urging of said power operated means.

4. The combination in a machine for the manufacture of concrete pipe as set forth in claim 3 wherein at least one vertically extending and vertically movable core guide is provided and connected with the core for relative sliding movement in such manner that the core is movable both vertically with and relative to the guide, wherein said guide ring support means is connected with said core guide for vertical movement therewith, and wherein said power operated means is connected with the core so as to move the core both vertically with and relative to its guide, movement of the core and guide together serving to move the guide ring support means between said first and second guide ring positions, and movement of the core both with and relative to its guide serving to move the core between its said first and second positions.

5. The combination in a machine for the manufacture of concrete pipe as set forth in claim 4 wherein a plurality of vertically extending core guides are provided in the form of guide rods mounted for limited vertical sliding movement, wherein the core is slidably mounted on the rods and the guide ring support means is fixedly mounted at end portions of the rods adjacent the jacket and pipe, and wherein said power operated means includes a first fluid operable cylinder having an actuating rod connected with the core for moving the same vertically, initial core movement from its said first toward its second position causing said rods to move therewith in unison to move said support means and guide ring from its said first to its second position, and further core movement occurring with the rods stationary and the core sliding therealong to its second position within the pipe.

6. The combination in a machine for the manufacture of concrete pipe as set forth in claim 5 wherein the core, the core guide rods, the guide ring and its support means are positioned above the pipe and jacket with the core suspended from the cylinder actuating rod, wherein the core guide rods are freely slidable and subject to gravity over a limited range of vertical travel, and wherein stops are provided on said rods to limit upward sliding movement of the core relative thereto, said initial core and guide rod movement in unison occurring downwardly to move the support means and guide ring downwardly until said guide ring reaches its said second position, said further core movement occurring downwardly relative to the guide rods and into the pipe, initial return core movement occurring upwardly out of the pipe and relative to the guide rods until said stops are engaged, and further upward core movement serving to lift the rods therewith and return the support means and guide ring to its first position.

7. The combination in a machine for the manufacture of concrete pipe as set forth in claim 6 wherein said stops are mounted on said guide rods above the core, and wherein the core is provided with ears slidable along the guide rods and engageable with the stops.

8. The combination in a machine for the manufacture of concrete pipe as set forth in claim 7 wherein a plurality of guide member are provided for said support means and slidably mount the support means externally of said core guide rods.

9. The combination in a machine for the manufacture of concrete pipe as set forth in claim 6 wherein the core is provided with a plurality of downwardly and inwardly inclined guide fingers at a lower end portion for axially aligned entry of the core within the pipe.

10. The combination in a machine for the manufacture of concrete pipe as set forth in claim 6 wherein said core is of a tubular sheet metal construction split along at least one axial line for radial expansion and contraction, wherein said power operated means also includes a second fluid operable cylinder positioned within the core and having an actuating rod, and wherein means is provided for connecting the actuating rod to the core on opposite sides of the axial split in the core.

11. The combination in a machine for the manufacture of concrete pipe as set forth in claim 5 wherein a radially expandable and contractable means is provided for connecting the acutating rod of said first fluid operable cylinder with the core, said means comprising a pair of relatively slidable members each having outer end portions connected with the core and inner end portions connected with the actuating rod.

12. In a machine for the "dry mix" packerhead manufacture of concrete pipe comprising at least one separable upright and vertically open tubular jacket for the formation of pipe therewith, a rotatable cylindrical packerhead having an external diameter substantially less than the internal diameter of said jacket, said packerhead being axially aligned with and movable vertically within and above said pipe jacket, "dry mix" delivery means disposed above and operatively associated with said packerhead for progressively depositing the mix atop the packerhead with the packerhead rotating and moving vertically upwardly within the jacket whereby to distribute the mix radially outwardly from the packerhead and to form a concrete pipe in the annular space between the jacket and the periphery of the packerhead; the improvement comprising a core operatively associated with said jacket and being approximately as long as the jacket and having an external diameter approximating the internal diameter of a pipe formed within said jacket, said core being of a tubular construction and adpated for radial expansion and contraction, radially expandable and contractable connecting and supporting means for said core, first and second power operated means operatively associated with said connecting and supporting means respectively for moving the core vertically between first and second positions relative to a jacket and formed pipe and for radially expanding and contracting the core, the first position being vertically displaced from the jacket and pipe and the second position being within and concentric with the pipe and jacket, said second power operated means serving also to contract the core during movement relative to the jacket and pipe and to expand the core into firm engagement with the internal diameter of the pipe when the core is in its said second position, and at least one vibratory operatively associated with the core for vibrating the same in its said expanded second position whereby to compact the pipe, to eliminate voids, and to relieve forming stresses therein.

13. The improvement in a machine for the manufacture of concrete pipe as set forth in claim 12 wherein said first and second power operated means include first and second fluid operable cylinders, wherein said core is split along at least one axial line, and wherein said second power operated means also includes linkage means connecting the actuating rod of said second fluid cylinder to the core on opposite sides of the axial split in the core.

14. The improvement in a machine for the manufacture of concrete pipe as set forth in claim 12 wherein an annular axial alignment means is provided in operative association with one end of the jacket, said axial alignment means having a cylindrical opening of a diameter substantially equal to the internal diameter of the pipe and serving to guide the core during vertical movement from its said first position to its second position within the pipe.

15. The improvement in a machine for the manufacture of concrete pipe as set forth in claim 12 wherein the core is disposed above the pipe and jacket in its said first position and is movable downwardly by said first operated means to its said second position within the pipe.

16. The improvement in a machine for the manufacture of concrete pipe as set forth in claim 12 wherein the core is disposed beneath the pipe and jacket in its said first position and is movable upwardly by said first power operated means to its said second position within the pipe.

17. In a machine for the "dry mix" packerhead manufacture of concrete pipe comprising at least one separable upright and vertically open tubular jacket for the formation of pipe therewithin, a rotatable cylindrical packerhead having an external diameter substantially less than the internal diameter of said jacket, said packerhead being axially aligned with and movable vertically within and above said pipe jacket, "dry mix" delivery means disposed above and operatively associated with said packerhead for progressively depositing the mix atop the packerhead with the packerhead rotating and moving vertically upwardly within the jacket whereby to distribute the mix radially outwardly from the packerhead and to form a concrete pipe in the annular space between the jacket and the periphery of the packerhead; the improvement comprising a core operatively associated with said jacket and being approximately as long as the jacket and having an external diameter approximating the internal diameter of a pipe formed within said jacket, said core being of a tubular construction and adapted for radial expansion and contraction, radially expandable and contractable connecting and supporting means for said core, power operated means operatively associated with said connecting and supporting means for expanding and contracting said core and for moving the core vertically between first and second positions relative to a jacket and formed pipe, the first position being vertically aligned with but displaced from the jacket and pipe and the second position being within and concentric with the pipe and jacket, said power operated means serving also to contract the core during movement relative to the jacket and pipe and to expand the core into firm engagement with the internal diameter of the pipe when the core is in its said second position, and said core connecting and supporting means serving further as a part of said power operated means for core expansion and contraction in the second position of the core, said connecting and supporting means including at least two radially inwardly and outwardly movable members, each of said members at outer end portions urging the core radially outwardly on radial outward movement, and each of said members having inner end portions power driven at least in its radial outward direction of movement, and at least one vibrator operatively associated with the core for vibrating the same in its said expanded second position whereby to compact the pipe, to eliminate voids, and to relieve forming stresses therein.

18. The improvement in a machine for the manufacture of concrete pipe as set forth in claim 17 wherein said power operated means includes at least one axially movable actuating member, and wherein said core connecting and supporting means includes motion transmitting mechanism connected between said actuating member and said two radially movable members for urging said members radially outwardly on axial movement of said actuating member in one direction.

19. The improvement in a machine for the manufacture of concrete pipe as set forth in claim 18 wherein said motion transmitting mechanism includes at least one connecting link extending from each radially movable member to said actuating member and serving to urge the radially movable member outwardly on movement of the actuating member in said one direction.

20. The improvement in a machine for the manufacture of concrete pipe as set forth in claim 18 wherein said motion transmitting mechanism is connected to said radially movable members and said actuating member so as to positively urge said members in both radial outward and inward directions respectively on axial movement of said actuating member in one and an opposite direction.

21. The improvement in a machine for the manufacture of concrete pipe as set forth in claim 18 wherein said radially movable members are connected with the core at outer end portions so as to positively pull the core radially inwardly when they are moved radially inwardly.

22. The improvement in a machine for the manufacture of concrete pipe as set forth in claim 18 wherein the core is so constructed and arranged to inherently assume a contracted condition in its free state, and wherein said radially movable members urge the core to an expanded condition against reactive forces in the core itself.

23. The improvement in a machine for the manufacture of concrete pipe as set forth in claim 18 wherein the core is split along at least three axially extending lines, wherein three radially movable members are provided respectively for the three resulting core sections, and wherein each of said radially movable members is connected with and driven by said actuating member through said motion transmitting mechanism.

24. The improvement in a machine for the manufacture of concrete pipe as set forth in claim 18 wherein said power operated means includes a fluid operable cylinder, and wherein said actuating member takes the form of the actuating rod of the cylinder.

25. The improvement in a machine for the manufacture of concrete pipe as set forth in claim 24 wherein said fluid operable cylinder is adapted to move said core between its said first and second positions and also to expand and contract the core, the cylindrical actuating rod having a stroke sufficiently long to move the core between said positions and to over travel slightly when the core reaches its second position whereby to cause said motion transmitting mechanism to drive said radially movable members outwardly and to expand the core.

26. The improvement in a machine for the manufacture of concrete pipe as set forth in claim 25 wherein said core includes a stop means movable therewith, and wherein an associated fixed stop means is provided for engagement with the core stop means to stop the core at its said second position and to cause said actuating rod over travel to operate said motion transmitting mechanism as aforesaid.

* * * * *